US005144223A

United States Patent [19]

Gillingham

[11] Patent Number: 5,144,223

[45] Date of Patent: Sep. 1, 1992

[54] BANDGAP VOLTAGE GENERATOR

[75] Inventor: Peter B. Gillingham, Kanata, Canada

[73] Assignee: Mosaid, Inc., Ontario, Canada

[21] Appl. No.: 667,880

[22] Filed: Mar. 12, 1991

[51] Int. Cl.[5] ..... G05F 3/20

[52] U.S. Cl. ..... 323/313; 323/315; 323/281; 323/907

[58] Field of Search ..... 323/313, 314, 315, 316, 323/281, 907; 307/296.1, 296.6, 296.7

[56] References Cited

U.S. PATENT DOCUMENTS

| | | | |
|---|---|---|---|
| 4,450,367 | 5/1984 | Whatley | 323/315 |
| 4,849,684 | 7/1989 | Sonntag et al. | 323/313 |
| 4,868,483 | 9/1989 | Tsujimoto | 323/313 |
| 4,890,052 | 12/1989 | Hellums | 323/315 |

*Primary Examiner*—Peter S. Wong
*Attorney, Agent, or Firm*—Laff, Whitesel, Conte & Saret

[57] ABSTRACT

A bandgap voltage generator useful in CMOS integrated circuits using intrinsic bipolar transistors. The generator is comprised of a pair of bipolar voltage generator which utilizes bipolar devices in a common collector configuration. Therefore for the first time a bandgap voltage reference using the intrinsic vertical bipolar transistor can be implemented in a CMOS chip without the need for an operational amplifier. In order to provide the above, an embodiment of the present invention is a bandgap voltage generator comprising a pair of bipolar transistors connected in common collector configuration with ratioed resistors on the emitters to define branch current and provide temperature compensation, and field effect transistors connected as source followers in series with the emitters of the bipolar transistors for establishing bandgap potential across the resisters and base-emitter junctions, a current comparator connected in series with the drains of the first pair of field effect transistors for controlling the emitter-collector currents in the bipolar transistors, the current comparator and the common collector being connected across a power source.

16 Claims, 3 Drawing Sheets

BANDGAP VOLTAGE GENERATOR

FIELD OF THE INVENTION

This invention relates to a circuit for fixing a voltage difference which is independent of process, supply voltage and temperature in a semiconductor circuit which is commonly referred to as a bandgap voltage generator, and is useful in CMOS integrated circuits.

BACKGROUND TO THE INVENTION

Bandgap voltage generators are generally used to create a voltage which is equal to the bandgap potential of silicon devices at 0° Kelvin. There are several basic techniques used to generate the bandgap voltage, which is approximately 1.2 volts.

In one technique, equal currents are passed through two diodes of different sizes; in another different currents are passed through different equal sized diodes. In both cases the voltage across each diode is a function of the current density, equal to the current passed by the diode divided by its area, which is larger in one diode than the other. The two diodes will have different voltage drops, as defined by the exponential diode law. The voltage difference between the two diode drops has a positive temperature coefficient, and can be scaled to offset the approximate −2.0 mv/°C. temperature coefficient of the absolute diode voltage drop itself. A circuit which does this produces the 1.2 volt bandgap voltage independent of temperature.

A wide variety of circuits have been published to perform this function, many of them employing operational amplifiers (for example, as described in the article "CMOS Voltage Preferences Using Lateral Bipolar Transistors" by M. Degrauwe, IEEE JSSC, Vol. SC-20, No. 6, December 1985, p. 1151). In low power applications the current consumed in the various stages of an operational amplifier and in the operational amplifier bias chain is a disadvantage.

Other circuits have been proposed which require no operational amplifier and the only currents flowing are those through the bipolar devices (see the article "MOS Transistors Operated in CMOS Technology", by E. Vittoz et al, IEEE JSSC, Vol. SC-18, June 1983, P. 273). Those circuits require transistors connected in common emitter configuration.

A lateral bipolar transistor in a typical CMOS process could be used in common emitter configuration but these devices have poor performance. Bipolar devices with reasonable performance which can be integrated in CMOS circuits without special processing steps consist of a vertical structure comprised of a substrate, and well and source/drain diffusions for the collector, base and emitter respectively and can only be employed in common collector configurations. Until the present invention therefore a bandgap voltage generator requiring no operational amplifier could not be provided using the common collector vertical bipolar devices.

SUMMARY OF THE PRESENT INVENTION

The present invention provides a bandgap voltage generator which utilizes bipolar devices in a common collector configuration in a single stage, providing a bandgap voltage reference using the intrinsic vertical bipolar transistor which can be implemented in a CMOS chip without the need for an operational amplifier.

In order to provide the above, an embodiment of the present invention is a bandgap voltage generator comprising a pair of bipolar transistors connected in common collector configuration with ratioed resistors on the emitters to define branch current and provide temperature compensation, and field effect transistors connected as source followers in series with the emitters of the bipolar transistors for establishing bandgap potential across the resistors and base-emitter junctions, a current comparator connected in series with the drains of the first pair of field effect transistors for controlling the emitter-collector currents in the bipolar transistors, the current comparator and the common collector being connected across a power source.

Another embodiment of the invention is a bandgap voltage generator comprising first apparatus for carrying a pair of currents which are equal at a predetermined potential, apparatus for establishing the potential and applying it to said first apparatus, apparatus for monitoring the pair of currents and controlling the potential at which the currents are equal, whereby the potential is fixed at the bandgap voltage.

BRIEF INTRODUCTION TO THE DRAWINGS

A better understanding of the invention will be obtained by reference to the detailed description below with reference to the following drawings, in which:

FIGS. 1A and 1B are schematic diagrams of the invention in its basic form, FIG. 1C is a graph of voltage vs temperature used to illustrate the invention, FIG. 2 is a current vs voltage curve used to illustrate the invention, FIG. 3 is a voltage vs voltage curve used to illustrate the operation of the present invention, FIG. 4 is a schematic diagram of a variation of the present invention, FIG. 5 is a schematic diagram illustrating another embodiment of the invention, and FIG. 6 is a schematic diagram illustrating a variation of a portion of the present invention.

DETAILED DESCRIPTION OF THE INVENTION

Figure 1A:
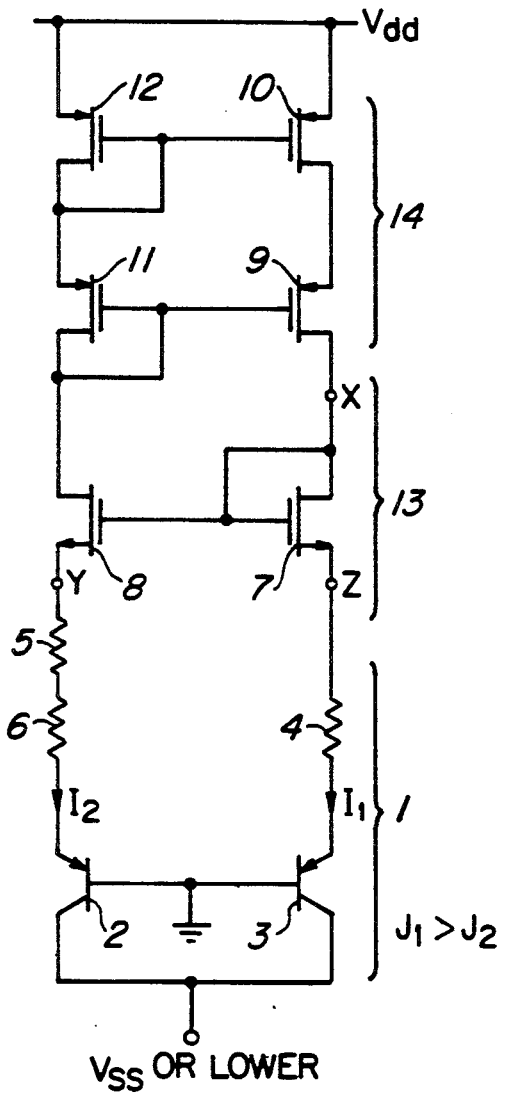
Figure 1B:
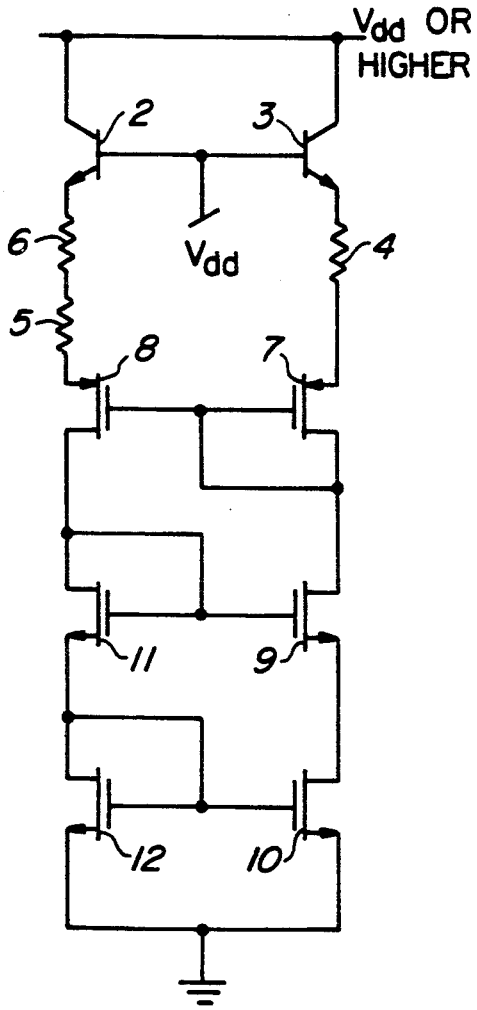

Turning to FIG. 1A, a bandgap potential difference generator 1 is illustrated comprised of a pair of bipolar transistors 2 and 3 connected in a common collector configuration. The transistors shown are of PNP type although NPN devices could be used by reversing the direction of current flow and substituting N-channel for P-channel devices and vice versa in the remainder of the circuit as shown in FIG. 1B. However for the purpose of explanation, the polarity of FIG. 1A will be referenced below.

The bases are connected together and to ground, and the collectors are connected together to ground or to a lower voltage than ground, e.g. $V_{SS}$ or lower.

Figure 1C:
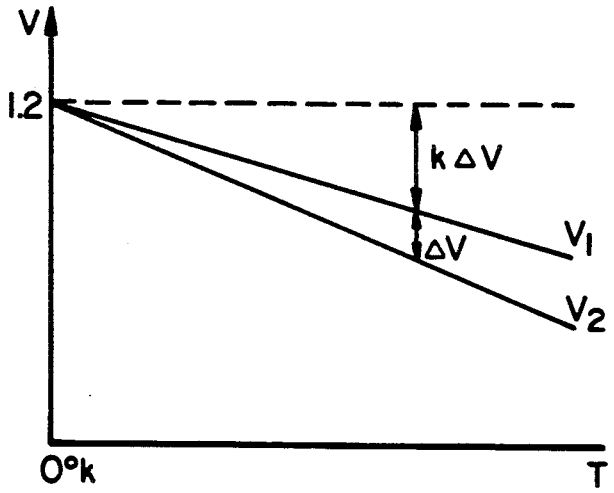

Resistor 4 is connected in series with the emitter of transistor 3 and resistors 5 and 6 are connected in series with the emitter of transistor 2. The combination of the resistance of resistors 5 and 6 is greater than that of resistor 4. With reference to FIG. 1C, resistor 6 is selected to drop a voltage $\Delta V$ and both resistors 4 and resistor 5 drop a voltage $K\Delta V$ as shown in FIG. 1A so that the temperature compensation exists at points Y and Z.

A first pair of field effect transistors 7 and 8, preferably of N-channel type have their gates connected together and source followers with their sources in series with resistors 4 and 5 respectively. By controlling the gates of these source followers, the points X and Y can be forced to equal potentials.

A second pair of field effect transistors, both being of opposite channel type to transistor 7 are connected in series with the drain of transistor 7, i.e., the drain of transistor 10 is connected to the source of transistor 9, and the drain of transistor 9 is connected to the drain of transistor 7. The source of transistor 10 is connected to an external high level voltage source $V_{dd}$.

A third pair of transistors which are of similar channel conductivity type as transistors 9 and 10 are connected in series, with the drain of transistor 12 being connected to the source of transistor 11, the drain of transistor 11 being connected to the drain of transistor 8, and the source of transistor 12 being connected to voltage source $V_{dd}$. The gate of transistor 12 is connected to its own drain and the gate of transistor 11 is connected to its own drain. The gates of transistors 9 and 11 are connected together and the gates of transistors 10 and 12 are connected together.

Transistors 7 and 8 function as a source follower 13 and transistors 9, 10, 11 and 12 function as a current comparator 14. If the currents in each branch are different, transistors 10 and 12, and transistors 9 and 11 should be ratioed accordingly. Alternatively transistors 10 and 12 and transistors 9 and 11 can be equal in size, and the currents passing through them are controlled to be equal.

In the circuit shown in FIG. 1 the drain of transistor 7 is connected to its gate, so that the output of the current comparator drives the source follower to force equal voltages at Y and Z.

In operation, transistors 7 and 8, the source follower 13 forces the voltages at points X and Y to be equal. The current comparator 14 forces the voltage at X and Y to be the voltage that causes the current densities passing through the emitters of transistors 2 and 3 to be a predetermined ratio. The voltages at the points Y and Z are thus equal, and are equal to the bandgap voltage.

The current comparator is shown as a cascode current mirror, but could instead be a simple two transistor current mirror or other type of current comparator.

Figure 2:
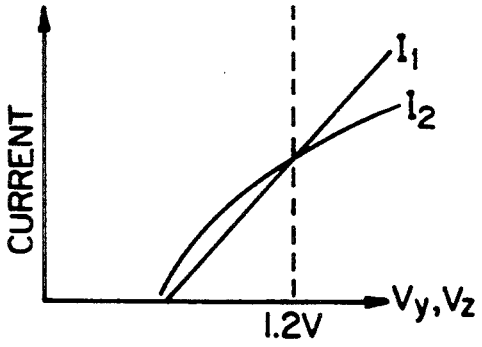
Figure 3:
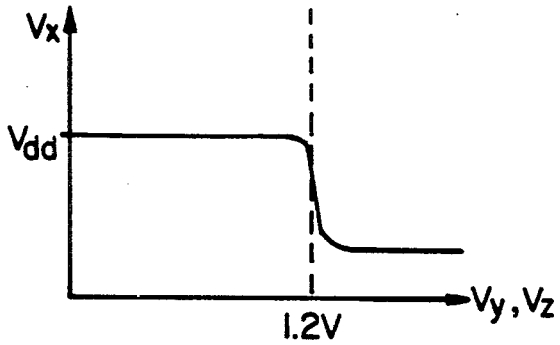

FIGS. 2 and 3 are curves used to illustrate operation of the invention in the case where branch currents are equal. As the currents I1 and I2 passing into the emitters of transistors 3 and 2 respectively are increased by controlling the gate voltage of transistors 7 and 8, it may be seen that due to the different sizes, they change at different rates, as the voltage at points Y and Z increase. At a particular predetermined voltage, the bandgap voltage (1.2 volts) the currents are equal. This is the closed-loop operating point of the circuit.

The current comparator output forces the voltage at Y and Z to be the voltage at which the currents through the bipolar transistors are equal.

FIG. 3 illustrates the open loop voltage response at point X. At a voltage VY, VZ lower than 1.2 volts, the voltage at X is approximately equal to $V_{dd}$ due to gain in the the current comparator and because $I_2$ is larger than $I_1$. At a voltage VY, VZ greater than 1.2 point X falls to a low value. Negative feedback in the circuit ensures that the voltage at point X is exactly that required to force the bandgap potential at Y and Z.

Figure 4:
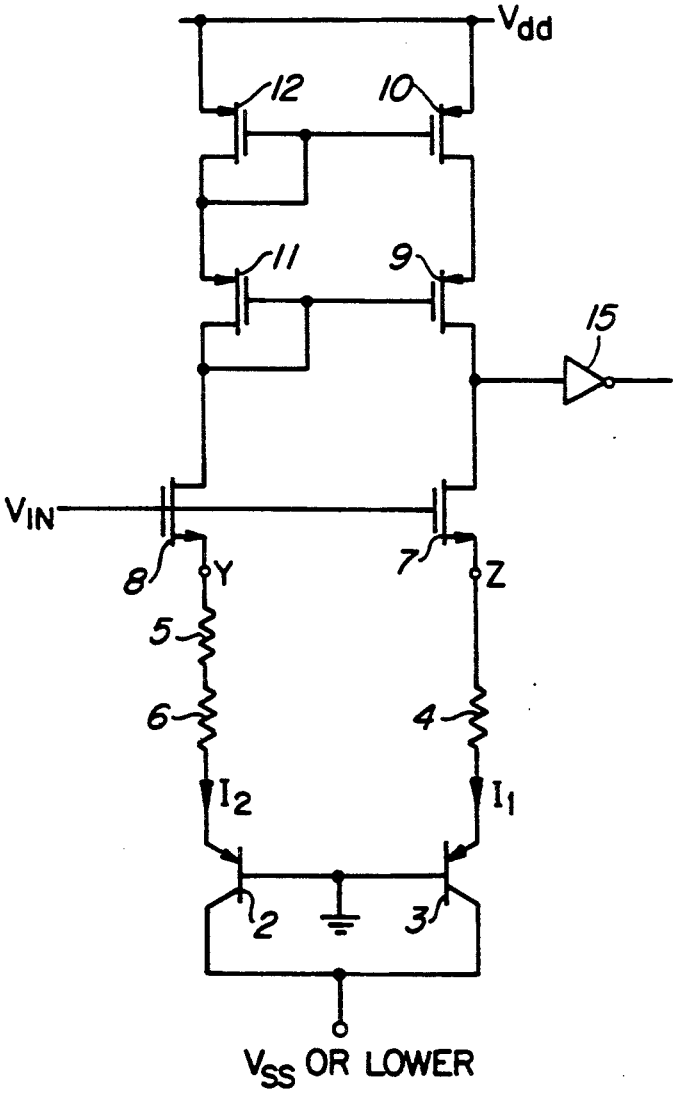

The circuit shown in FIG. 1 can be modified to function as a comparator, which compares an input voltage to the bandgap potential. FIG. 4 is similar to FIG. 1, except that the drain of transistor 7 is not short-circuited to its gate. An input voltage to be compared is connected to the gates of transistors 7 and 8. An output logic level is sensed at the drain of transistor 7, which can be obtained at the output of an inverter 15 which has its input connected to the drain of transistor 7.

The output of inverter 15 provides a logic "zero" if the input voltage is smaller than the voltage at point Z plus the gate source voltage drop across transistors 7 and 8, and provides a logic "1" if the input voltage is larger than the voltage at position Z plus the gate-source voltage drop across transistors 7 and 8.

Figure 5:
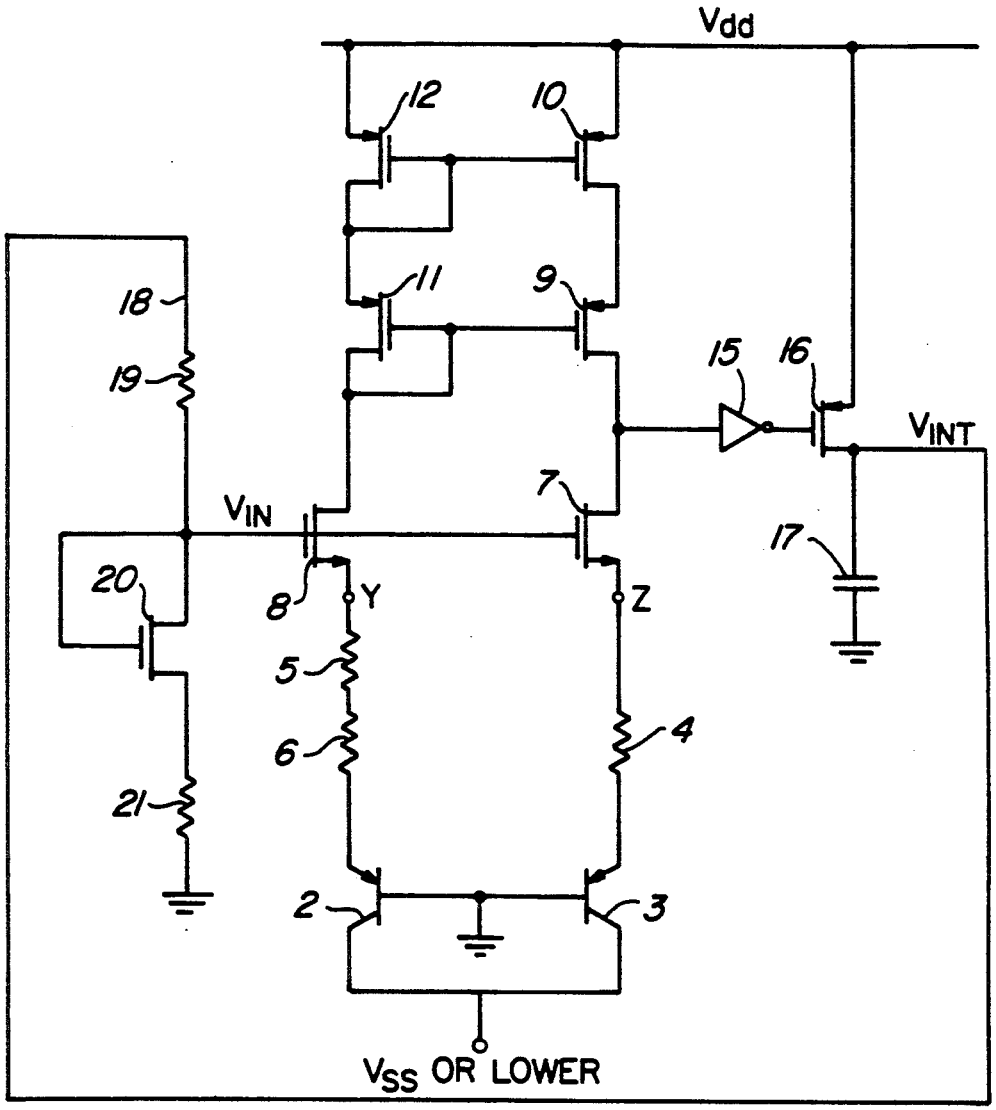

FIG. 5 illustrates a variation of the embodiment of FIG. 4 to realize a complete internal supply voltage generator. The output logic level referred to above is applied to the gate of a field effect transistor 16, which is connected between the external voltage source $V_{dd}$ and a capacitor 17 which is connected to ground. Thus when there is an appropriate logic level to turn on transistor 16, the voltage $V_{dd}$ is extended to capacitor 17, which charges, acting as a current reservoir. In addition, the voltage across capacitor 17 provides an internal supply to, for example, a high density dynamic random access memory where an internal reduced voltage supply must be employed to reduce stress on short channel devices.

When the internal supply reaches the desired level, the logic level at the output of inverter 15 reverses, transistor 16 is switched off, cutting the current path from source voltage $V_{dd}$ to the reservoir capacitor 17.

Thus the input voltage can be sensed as compared to the bandgap potential and switch on the internal power supply to a dynamic random access memory or other circuity.

The input voltage can be derived from the internal supply scaled by a voltage divider. The voltage divider which is shown in FIG. 5 is comprised of resistor 19 connected from the requested internal voltage $V_{int}$ to the gates of transistors 7 and 8, the drain of the field effect transistor 20 which has its gate shorted to its drain, and a resistor 21 which is connected between ground and the source of transistor 20.

The voltage divider network, including the N-channel transistor 20 divides the internal voltage $V_{int}$ down to the comparator input voltage level, which is the bandgap potential plus the voltage across one N-channel field effect transistor, for inputting to the bandgap circuit, i.e. to the gates of transistors 7 and 8. However the latter-described voltage divider circuit exhibits sensitivity to process and temperature variations in threshold voltage, and can be replaced by the unity gain differential amplifier circuit shown in FIG. 6.

Figure 6:
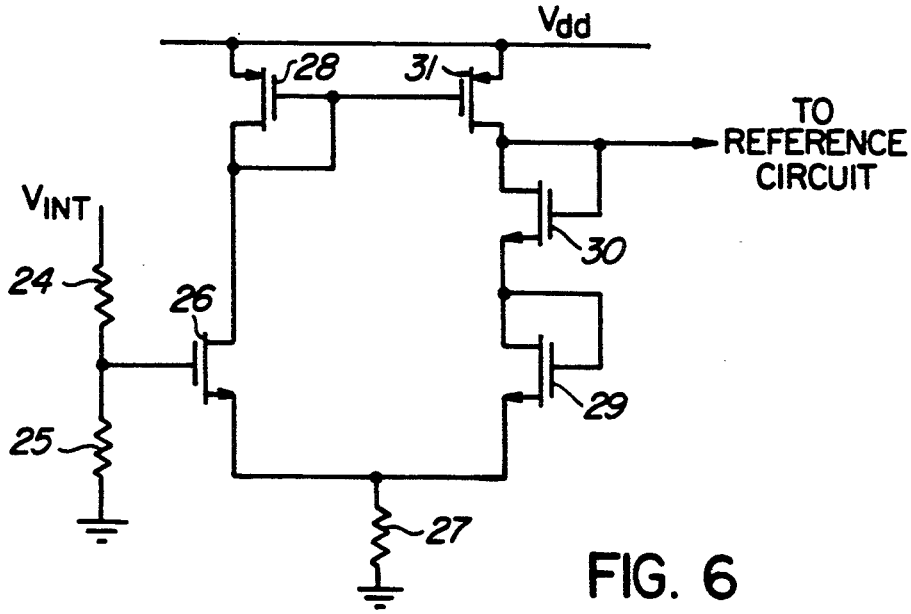

FIG. 6 illustrates a resistor divider formed of the series of resistors 24 and 25 connected between an external voltage source and ground. The junction of the resistors 24 and 2 is connected to the gate of N-channel field effect transistor 26, which has its source connected through a load resistor 27 to ground. The drain of transistor 26 is connected to the drain of a P-channel transistor 28 which has its gate connected to its drain, and its source connected to the voltage source $V_{dd}$.

Series connected N-channel transistors 29 and 30 each has its gate connected to its drain. The drain of transistor 29 is connected to the source of transistor 30 and the source of transistor 29 is connected, with the source of transistor 26, to resistor 27. The drain of transistor 30 is connected to the drain of transistor 31, which is of similar conductivity type as transistor 28. The source of transistor 21 is connected to voltage source $V_{dd}$ and the gate of transistor 31 is connected to the gate of transistor 28. The drain of transistor 30 provides the input voltage to the gates of transistors 7 and 8 in FIGS. 4 and 5, compensating for gate source voltage drop of transistors 7 and 8.

In operation, resistors 24 and 25 reduce the desired internal voltage $V_{int}$ to the bandgap potential, the reduced voltage being applied the gate of transistor 26. A current mirror formed of transistors 31 and 28, and diodes formed of transistors 29 and 30 fix the voltage to the input voltage for the circuits of FIGS. 4 and 5. The voltage at the gate of transistor 26 is scaled to be equal to the bandgap voltage of 1.2 volts.

The divider illustrated in FIG. 6 will draw slightly higher current than the voltage divider described earlier with respect to FIG. 5, but is less sensitive to process and temperature variations in threshold voltage.

A person understanding this invention may now conceive of alternative structures and embodiments or variations of the above. All which fall within the scope of the claims appended hereto are considered to be part of the present invention.

I claim:

1. A bandgap voltage generator comprising:

(a) a pair of bipolar transistors connected in common collector configuration, (b) resistors in series with bipolar transistor emitters for establishing a positive temperature coefficient voltage drop sufficient to offset a negative emitter-base voltage drop, (c) a first pair of field effect transistors connected as a source follower in series with the emitters of the bipolar transistors for establishing a bandgap potential difference, (d) a current comparator connected in series with the drains of the first pair of field effect transistors, whose output drive the gates of said first pair of transistors for controlling the emitter currents in the bipolar transistors, and (e) said current comparator and said common collector being connected across a power source.

2. A bandgap generator as defined in claim 1, in which one of the two bipolar transistors is physically larger than the other, and in which the current comparator includes means for controlling the emitter-collector currents in the bipolar transistors to be equal.

3. A bandgap generator as defined in claim 1, in which the two bipolar transistors are equal in physical size, and in which the current comparator includes means for controlling the emitter-collector currents in the bipolar transistor to be greater in one transistor than in the other.

4. A bandgap generator as defined in claim 1, in which the two bipolar transistors are different in physical size, and in which the current comparator includes means for controlling the emitter-collector currents in the bipolar transistor to be greater in one transistor than in the other.

5. A bandgap voltage generator as defined in claim 1 including means for comparing an input voltage to a bandgap potential level of said bandgap potential difference comprising:

(i) means for applying an input voltage to the gate of the first pair of transistors, and (ii) means for sensing a logic voltage level at the drain of one of said first pair of transistors, whereby the logic level changes depending on whether the input voltage is higher or lower than the bandgap potential plus an N-channel threshold.

6. A bandgap voltage generator comprising:

(a) a pair of similar polarity type bipolar transistors having their bases connected together to ground and their collectors connected together to a voltage level less than or equal to ground, a first one of the transistors being physically larger than the other, (b) a pair of resistive means connected in series with the emitters of the transistors, the resistive means connected to said first transistor having larger resistance than the other, (c) a first similar pair of similar conductivity type field effect transistors being connected with their sources in series with respective ones of said resistive means, the gates of said field effect transistor being connected together, (d) a second pair of similar conductivity type field effect transistors having conductivity type opposite that of the first pair of field effect transistors, the drain of one thereof being connected to the source of the other, the source of said one thereof being connected to a high level voltage source $V_{dd}$, and the drain of said other thereof being connected to the drain of one of said first pair of field effect transistors, (e) a third pair of field effect transistors of similar type to said second pair of field effect transistors, each having its gate connected to its drain, the drain of one being connected to the source of the other, and its source being connected to said voltage source $V_{dd}$, the drain of the other being connected to the drain of the other of the first pair of field effect transistors, (f) the gate of said one of said first pair of field effect transistors being connected to its drain, whereby a bandgap voltage is effected at the sources of said first pair of field effect transistors.

7. A bandgap voltage generator as defined in claim 6, in which the values of said resistors are selected to create a positive coefficient voltage reference.

8. A bandgap voltage generator as defined in claim 6, in which the values of said resistors are selected to create a negative coefficient voltage reference.

9. A bandgap voltage generator comprising:

(a) a pair of similar polarity type bipolar transistors having their bases connected together to ground and their collectors connected together to a voltage level less than or equal to ground, a first one of the transistors being physically larger than the other, (b) a pair of resistive means connected in series with the emitters of the transistors, the resistive means connected to said first transistor having larger resistance than the other, (c) a first similar pair of similar conductivity type field effect transistors being connected with their sources in series with respective ones of said resistive means, the gates of said field effect transistor being connected together, (d) a second pair of similar conductivity type field effect transistors having conductivity type opposite that of the first pair of field effect transistors, the drain of one thereof being connected to the source of the other, the source of said one thereof being connected to a high level voltage source $V_{dd}$, and the drain of said other thereof being connected to the drain of one of said first pair of field effect transistors, (e) a third pair of field effect transistors of similar type to said second pair of field effect transistors, each having its gate connected to its drain, the drain of one being connected to the source of the other, and its source being connected to said voltage source $V_{dd}$, the drain of the other being connected to the drain of the other of the first pair of field effect transistors, and further including means for comparing an input voltage with a bandgap potential comprising:

(g) means for applying an input voltage to the gates of said first pair of field effect transistors, and (h) means for providing a logic level output at the drain of said first pair of field effect transistors representing the level of the input voltage compared to said bandgap potential.

10. A bandgap voltage generator as defined in claim 6 in which said bipolar transistors are of NPN type and said first pair of field effect transistors are P-channel conductive types.

11. A bandgap voltage generator as defined in claim 9, in which said bipolar transistors are of NPN type and said first pair of field effect transistors are of P-channel conductivity types.

12. A bandgap voltage generator as defined in claim 6, in which said bipolar transistors are of PNP type and said first pair of field effect transistors are N-channel conductivity types.

13. A bandgap voltage generator as defined in claim 9, in which said bipolar transistors are of PNP type and said first pair of field effect transistors are N-channel conductivity types.

14. A bandgap voltage generator as defined in claim 9 further including a voltage divider connected across a voltage source for providing a stepped-down said input voltage.

15. A bandgap voltage generator as defined in claim 6 further comprising a field effect transistor switch having one side of its drain-source circuit connected to the high level voltage source $V_{dd}$, the other side connected to a reservoir capacity for a regulated voltage output, a bandgap voltage reference and a comparator connected between the other side of said drain-source circuit and ground, and the output of the bandgap voltage reference and comparator connected to the gate of said field effect transistor switch, whereby a power supply can be provided to circuits connected across said capacitor depending on the level of said regulated voltage output.

16. A bandgap voltage referenced voltage regulator comprising a field effect transistor switch having one side of its drain-source circuit connected to a high level voltage source $V_{dd}$ and the other side connected to a reservoir capacitor for a regulated voltage output, a bandgap voltage reference as defined in claim 1 connected between the other side of said drain-source circuit and ground, the output of the bandgap voltage reference connected to the gate of said field effect transistor-switch, whereby a power supply can e provided to circuits connected across said capacitor depending on the level of said regulated voltage output.

* * * * *